US007794571B2

(12) United States Patent
Lepomäki et al.

(10) Patent No.: US 7,794,571 B2
(45) Date of Patent: Sep. 14, 2010

(54) METHOD FOR MANAGING LAMELLA VIBRATIONS OF A LIP CHANNEL OF A HEAD BOX AND THE LAMELLA FOR THE LIP CHANNEL OF THE HEADBOX

(75) Inventors: Hannu Lepomäki, Tampere (FI); Petri Jetsu, Vaajakoski (FI); Jukka T. Heikkinen, Jyväskylä (FI); Ari Puurtinen, Jyväskylä (FI); Juhana Lumiala, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 483 days.

(21) Appl. No.: 11/909,246

(22) PCT Filed: Mar. 8, 2006

(86) PCT No.: PCT/FI2006/050093

§ 371 (c)(1),
(2), (4) Date: Sep. 20, 2007

(87) PCT Pub. No.: WO2006/100343

PCT Pub. Date: Sep. 28, 2006

(65) Prior Publication Data

US 2008/0110588 A1 May 15, 2008

(30) Foreign Application Priority Data

Mar. 24, 2005 (FI) ..... 20050315

(51) Int. Cl.
*D21F 1/02* (2006.01)
*D21F 1/06* (2006.01)

(52) U.S. Cl. ..... 162/343; 162/259

(58) Field of Classification Search ..... 162/198, 162/259, 262, 263, 216, 343
See application file for complete search history.

(56) References Cited

U.S. PATENT DOCUMENTS 4,526,653 A * 7/1985 Andersson ..... 162/259
4,539,073 A * 9/1985 Andersson ..... 162/198
4,654,546 A 3/1987 Kirjavainen
5,639,352 A 6/1997 Ruf et al.

(Continued)

FOREIGN PATENT DOCUMENTS

DE 4237310 * 4/1993

(Continued)

OTHER PUBLICATIONS

DE 4237310, Apr. 1993, English language machine translation [retrieved from http://ep.espacenet.com].*

(Continued)

*Primary Examiner*—Eric Hug
(74) *Attorney, Agent, or Firm*—Stiennon & Stiennon

(57) ABSTRACT

A procedure and arrangement to control the lamella of a headbox's lip channel, when the mass flow goes in the headbox (3) through the lip channel (2), in which case single mass flows are held separate from each other with the lamella (1) before the flows are united after the lamella. The lamella's dimensions, mechanical characteristics and/or dynamic characteristics are changed at least in the lamella's border area with an active structure, which is active and/or passive active tool and/or active and/or passive active material.

17 Claims, 2 Drawing Sheets

U.S. PATENT DOCUMENTS 6,902,650 B2 * 6/2005 Park et al. ..... 162/216

FOREIGN PATENT DOCUMENTS

| | | | | |
|---|---|---|---|---|
| DE | 10249820 | | * | 5/2004 |
| FI | 111277 | B | | 6/2003 |
| FI | 113382 | B | | 4/2004 |
| WO | 03/062527 | A1 | | 7/2003 |
| WO | WO 03/062527 | | * | 7/2003 |
| WO | 2006/100343 | A1 | | 9/2006 |

OTHER PUBLICATIONS

DE 10249820, May 2004, English language machine translation [retrieved from http://ep.espacenet.com].*

Written Opinion of the International Searching Authority in PCT/FI2006/050093.

International Search Report in PCT/FI2006/050093.

Search Report in FI 20050315.

Emfit Technology, web page printout http://www.emfit.com/technology © 2000-2006 Efmit Ltd. printed Sep. 13, 2007.

* cited by examiner

METHOD FOR MANAGING LAMELLA VIBRATIONS OF A LIP CHANNEL OF A HEAD BOX AND THE LAMELLA FOR THE LIP CHANNEL OF THE HEADBOX

CROSS REFERENCES TO RELATED APPLICATIONS

This application is a U.S. national stage application of international app. No. PCT/FI2006/050093, filed Mar. 8, 2006, the disclosure of which is incorporated by reference herein, and claims priority on Finnish App. No. 20050315, filed Mar. 24, 2005.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention at hand is related to the head box of a fibrous web machine. More precisely the subject of the invention at hand is a method and an arrangement for managing a lamella vibration of a lip channel of a head box and the lamella for the lip channel of the head box.

In this context, the term head box stands for a unit of a fibrous web machine, as for example a paper machine, a board machine, a pulp drying machine, a tissue machine or similar, which is used in creating mass suspension before the forming unit. The function of the head box's function is to extend the mass suspension throughout the whole width of the fibrous web machine in a homogeneous flow that proceeds as a regular front. The mass suspension is fed from the head box's lip channel in the forming part. The head box's most common problems and weak points that are caused inhomogeneously and/or irregularly

- in the flow direction, and/or
- proceeding in a transversal lateral/vertical direction as for the flow direction from the mass flow of the mass suspension, various turbulences in the lip channel of the head box, lamellas' vibration problems, streak formation and other structure problems of the fibrous web line, such as level anomalies and blisters in the fibrous web.

In this context, the term lip channel stands for a channel throughout which the mass suspension flows through the head box in the machine direction or MD-direction through the nozzle part to the forming section. If the head box multi-layer and/or single-layer structured and has been realized with the so called long lamellas that extend in the MD-direction through the slice, the nozzle part has not necessarily been arranged in the structure, but the mass suspension flows through the slice into the forming section.

In this context, the term laminated structure, which is commonly also called "separation lamella", spline or whalebone, stands for at least one lamella situated in the head box's lip channel and extends

- in the machine direction or MD-direction near the slice at the end of the lip channel or even out from the slice, and
- in a transversal or CD-direction as for the MD-direction to the lip channel's width, and which is used in the lip channel to separate, in a vertical or Z-direction as for the MD-direction, from each other two or more single suspension flows which have the same or different viscosities, mass consistencies and/or chemical characteristics.

In this context, the definition lamella's border area stands for the end area or the head area of the lamella,

- which extends in the CD-direction to the whole width of the lip channel,
- which extends in the MD-direction near the slice or through the slice, and
- over which mass suspension flows.

The definition lamella's head stands for, in this context, in the MD-direction the lamella's remotest edge that extends in the CD-direction throughout the whole width of the lip channel through which the mass suspension flows into the slice or over/through it.

It is already common knowledge that laminated structures are used in the fibrous web machine's head box's lip channel. The lamellas can be regarded to be already sufficiently well known to an average craftsman. It is although necessary to notice that the lamellas' main purpose is, due to an increased turbulence production, to lower the tensile ratio of the fibrous web, as for example paper or board. In addition, with the help of the lamellas one can try a) to decrease the scale of the emerged turbulence, in which case effective factors are for example minor channel height, increased boundary layer turbulence and thin trailing head, and b) to prevent the confusion of the flows coming from different lines of the turbulence generator.

It is also already common knowledge that the problem is that the vibration of the lamella used in the head box's lip channel causes striation in the fibrous web, as for example in the paper web. Regarding yet this problem it can be noticed that the cockling of the lamella's trailing head can cause interferences in the flow that can be seen in the finished web as streaks.

In the patent specification FI 113382 is known a procedure to avoid or to reduce the turbulences that occur occasionally in the head box's lamellas, in a flow that goes through the paper machine's head box, when after the closed rear edge it develops a blind area. The publication suggests that the blind area should be rinsed with several minor flows, conducted from the main flow, that are formed with channels created in the lamella's surface. In order to realize the procedure the F10-publication suggests as the head box's lamella solution as follows.

- The lamella's final part has, as for the MD-direction, grooves that have been made forming at the edge of the lamella as if saw teeth or shoulders that are at least partially rounded.
- There are grooves in the lamella that are in the lamella's border area and in the same direction as the flow, in which case the grooves seen from above are rectangular or parabolic or shaped as a spline, in which case the broad side of the spline indicates in the flow's direction.

The basic idea of the patent specification FI 113382 is, therefore, that in the MD-direction the lamellas' border area or border has been shaped in order to reduce the emergence of flow interferences like vortices and turbulences, and thus to reduce the vibration created in the lamella. The solution for the lamella suggested by this FI publication requires a remarkable knowledge of flow technique and requires, in order to realize a functional flow solution, from the forming of the border area a particularly remarkable precision. In addition, the weak point of this solution is that it can work only as a basis for the planning in a chosen, restricted mass flow area.

SUMMARY OF THE INVENTION

One of the functions of the invention at hand is to create, in order to eliminate or substantially reduce the above-mentioned general and specific problems or weak points related to the head box, like cockling, vibration and problems related to the production technique, a new and ingenious method to control the vibration/-s of the head box's lip channel's lamella/-s. A second function is to create, in order to eliminate or substantially reduce the above-mentioned general and specific problems or weak points related to the head box, like cockling, vibration and problems related to the production technique, a new and ingenious head box's lip channel's lamella or spline, in which case its vibration can be substantially controlled and the realization of the method in accordance with the invention can be supported.

The aims of the invention at hand can be achieved with the method in accordance with the invention for managing lamella vibration of a lip channel of a head box, when a mass flow goes in the head box through the lip channel, whereby single mass flows are held separate from each by means of the lamella before the same are united after the lamella, for example so that the lamella's dimensions, mechanical characteristics and/or dynamic characteristics are changed in the lamella's border area by means of an active structure, which is an active and/or passive active means and/or of an active and/or passive active material.

The aims of the invention at hand can also be achieved with an arrangement for managing a lamella of a lip channel of a head box, when a mass flow goes in the head box through the lip channel, whereby the said lamella keeps the said single mass flows separate from each other before the same unite after the lamella, for example so that the lamella's dimensions, mechanical characteristics and/or dynamic characteristics are changeable at least in the lamella's border area by means of the active structure, which is an active and/or passive active means and/or of an active and/or passive active material.

The active and/or passive active means and/or the active material can comprise or the active means and/or, for example the active material can be of piezo material, as for example a construction of a laminate of composite, in which case, suitable piezo materials are for example various piezo ceramics.

From here on for the active and/or passive active means and/or for the active material is used for simplicity the definition the active structure, which can be the active and/or passive active structure.

With an active and/or passive active structure it is possible, according to the invention's performance example considered advantageous, to measure and/or regulate the lamella's vibration, stiffness, hardness and/or change the lamella's dimensions, as for example thickness, extent and form.

Hence with the invention at hand can the lamella's, which can be in the CD-direction

- in its whole length substantially straight or in a non-wavy or non-cutting way, or in another substantially non-sculptured way,
- in the flow direction of the mass suspension in cross-section bullet-like or as for the mass suspension flows' control surfaces symmetrically or other-sided sculptured, dimensions are changed with an active structure, especially advantageously in a way that the lamella's dimension/length towards the slice in the MD-direction and/or the lamella's thickness in the Z-direction can be regulated. According to a third performance example of the invention at hand, can the rigidity and/or hardness of the lamella's border area be changed with an active structure.

In accordance with the invention at hand with an active/passive active structure it is also possible to produce in the lamella's border area desired vibration and measure and regulate the vibration of the lamella's border area. The desired vibration can be: equifrequent, but opposite to the vibration caused by the mass suspension's flow; vibration that changes frequency, with which can be produced in the lamella's border area or in the border compensated vibration, with which can be compensated the vibration of the lamella's border area or of the border, caused by the mass flow's field; or different frequenced interference flows, with which the harmonic vortex structures of the mass flow's flow field can be mixed.

In order to create the desired oscillation, it is advisable that the regulating unit's control impulse that controls the active structure is based on an instrumentation/measuring data, which can be obtained for example

- from the mass flow's flow field, which strength can vary,
- from the fibrous web, such as paper/pulp, which can be streaked, or
- from another external measuring data, for example with the help of an ultrasonic testing from the head of the lamella, which can oscillate.

When in accordance with the invention the mechanical and/or dynamic characteristics of the lamella are changed, the active structure is in accordance with the invention integrated to the lamella's border area. When the active structure is based on piezo material, as for example the laminate of the composite construction, in which there is applicable piezo ceramical material, can the active structure function actively and/or passively. The impulse of such active structure can be advantageously chosen or it can be a measured external parameter. The parameter can be for example temperature, light and its different wavelengths, pH, humidity and/or various strains such as compression, torsion, stretch, electric current, magnetic field, voice or other vibration etc.

In this case from the active structure as a response for the impulse is obtained for example: reversible metamorphosis; change in the electroconductivity, phase transition, rheological change; color change; formation of light and/or voice; light transmission change; changes in the refractive index; and/or elasticity modulus change. This change can function as a mechanical and/or dynamic characteristic of the changed lamella, or in order to realize this kind of desired change as a variable parameter.

In practice one can say that the active function of an active/passive active structure differs from the passive activity in the most significant way there, that with the active function it is possible to regulate better the lamella's border area's and/or border's behaviour, when the active function can be used more flexibly also as a control device of the mass suspension's processing, due to which the active function of the active structure is suitable for a wider range of fluctuation of the mass flow. The advantage of the invention is also that with the procedures in accordance with the invention and with the lamella it is easier to slow down the reflocculation of the mass suspension after the turbulence generator adjusting the lamella's vibration. In that case the forming's formation betters and it is possible to use higher mass suspension's consistencies.

The invention is described in the following only like an example with the help of one of its performance forms considered advantageous, referring to the attached patent drawings.

DESCRIPTION OF THE PREFERRED EMBODIMENTS

Figure 1:
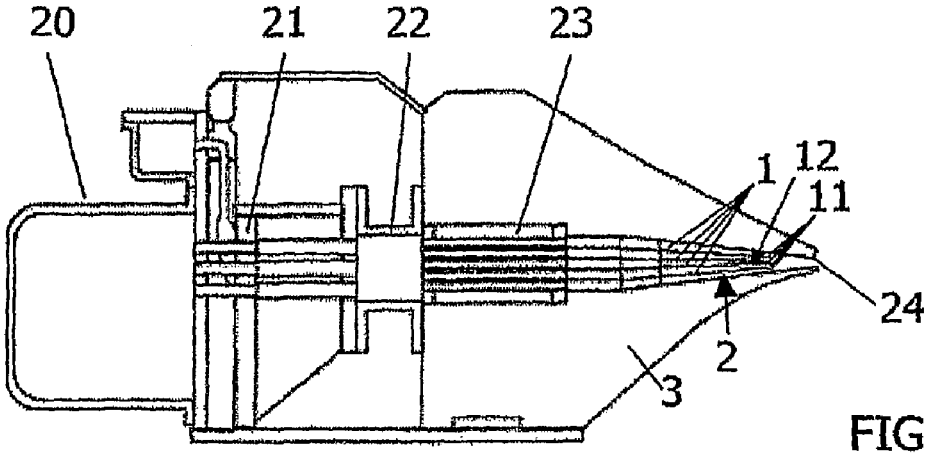
FIG. 1 represents generally the paper machine's single-layer head box, through which the mass flow goes, and in the lip channel of which the lamellas have been arranged.

Reference is made to FIG. 1, which represents, in the direction of the mass flow, a cross-section of a head box 3. The head box consists of a manifold 20, manifold pipes 21, distributing chamber 22 and after the turbulence generator 23, a lip channel 2. At the end of the lip channel 2 in the flow direction of the mass suspension, or in the MD-direction, the head box 3 consists of the slice. Inside the lip channel there have been arranged sequentially four pieces of lamellas 1. Through lip channel 2 of the head box the single mass flows flow differentiated by the lamellas 1 and the mass flows are united after the lamella structure at the end of the lip channel. This kind of a head box is already known, and there is no need to explain other structure configuration of the head box more precisely in order to explain the invention.

Figure 2:
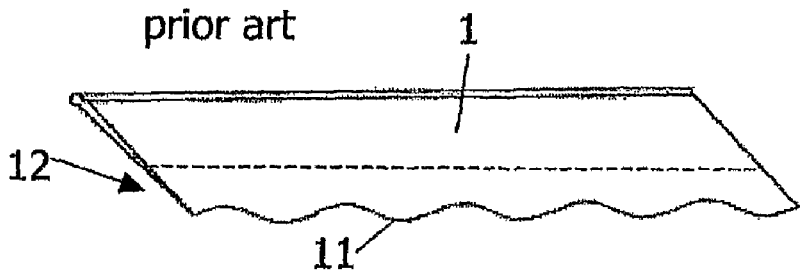
FIG. 2 represents the lamella structure of the prior art.

Referring to FIG. 2, where the lamella 1 is represented in accordance with the prior art, which typical weak point is that it can generate, due to the turbulences, intense flow structures that will be transmitted as striation in the fibrous web. For this kind of known lamella it is typical that its border area's 12 borders 11, in an operating situation, becomes undulatory shaped. In this case the lamella and especially its border area are easily shaped for example by the influence of viscosity changes in a vertical direction as for the MD-direction or in the Z-direction, which causes an irregular flow field in the mass flow, which causes striation in the forming fibrous web.

Regarding the invention at hand it can be said generally that the mechanical characteristics of the border area of the 12 lamella 1 consisted in the lamella structure, are changed using at least in the lamella's border area active and/or passive active material and/or an active means, which from here on will be called active structure 4. In accordance with the inventions basic idea with the help of the active structure can be measured, regulated and/or influenced

- in the mechanical characteristics of the lamella or at least of the lamella's border area, as for example in the hardness and stiffness,
- in the dimensions of the lamella or at least of the lamella's border area, as for example in the thickness in the Z-direction, in the extent in the MD-direction and/or in the width in the CD-direction,
- in the dynamic characteristics of the lamella or at least of the lamella's border area, as for example in the vibration.

In this case the mechanical and/or dynamic characteristics of the lamella structure are changeable at least in the lamella's border area.

In order to change the dynamic characteristics, in accordance with the invention with the active structure 4 can be measured, regulated and/or contributed to the vibrations of the lamella 1 or at least of its border area 12 and/or generate in the lamella or at least in its border area desired vibration in order to eliminate the vibration in the lamella caused by the mass suspension flow, which can generate striation in the fibrous web. The desired vibration can be: equifrequent, but opposite to the vibration caused by the mass suspension's flow; vibration that changes frequency, with which can be produced in the lamella's border area or in the border compensated vibration, with which can be compensated the vibration of the lamella's border area or of the border, caused by the mass flow's field; or for example different frequenced interference flows, with which the harmonic vortex structures of the mass flow's flow field can be mixed.

In order to create the desired vibration, it is preferable that as the active structure 4 is applied an active structure, and that the regulating unit's control impulse that controls the active structure is based on measuring data, which can be obtained for example from the mass flow's flow field, which strength can vary; from the fibrous web, such as paper/pulp, which can be streaked; or from another external measuring data, for example with the help of an ultrasonic testing from the head of the lamella 1, which can oscillate. An advantageous source of measuring data is for example the mass suspension's flow field, fibrous web, like paper web/pulp, ultrasonic testing for example from the head of the lamella or from the border area 12 or vibration testing from the lamella's head or border area.

In order to change the mechanic characteristics, with the active structure 4 one can in accordance with the invention influence in the lamella's 1 or its border area's 12 hardness, stiffness and/or dimensions, in this case with the active structure it is possible to change/regulate for example: the stiffness and/or hardness of the lamella's border area 12; the lamella's or its border area's extent in the MD-direction; the lamella's or border area's width in the CD-direction; and/or the lamella's or its border area's thickness in the Z-direction.

Regardless of if with the invention one tries to influence in the lamella's 1 border area's 12 mechanical and/or dynamic characteristics, in accordance with the invention, it is used in the lamella an active structure, advantageously as integrated in the lamella's border area, which typically is active material based on piezo material or an active means based on piezo material.

The active structure 4 can function as an active or passive active material and/or active means. The impulse of the active structure or the measured parameter have been chosen from a group that consists of: temperature, light and its different wavelengths, pH, humidity and/or various strains such as compression, torsion, stretch, electric current, magnetic field, voice or other vibration etc. As a response for this kind of impulse or parameter in the active structure is obtained for example: reversible metamorphosis; change in the electroconductivity, phase transition, rheological change; color change; formation of light and/or voice; light transmission change; changes in the refractive index; elasticity modulus change. This change can function as a mechanical and/or dynamic characteristic of the changed lamella, or in order to realize this kind of desired change as a variable parameter.

Figure 3:
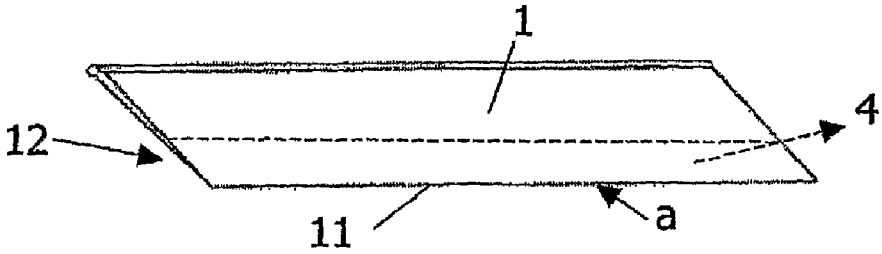
FIG. 3 represents one possible advantageous execution example of one performance form considered advantageous of a lamella in accordance with the invention at hand.

Referring to FIG. 3, where it is illustrated a lamella 1 in accordance with the invention at hand. Typically for the invention at hand the border area's border 11 of the lamella 1 is substantially straight (a). From this basic form it is possible to shape the lamella's border area and/or border in accordance with the invention at hand with the active structure and thus in order to keep the mass flow's flow field regular and in the desired thickness, in order to be able to reduce substantially turbulences, irregular turbulence in the lamella's trailing edge, which cause vibration and striation in the fibrous web. The advantage of a shapeable lamella is also that in this way it is possible to regulate the paper web's fiber alignment.

Figure 4:
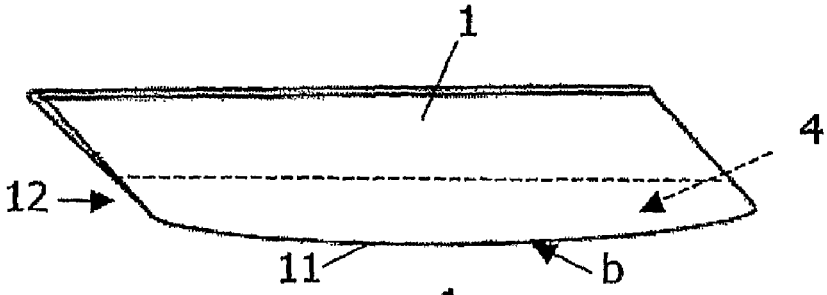
FIG. 4 represents a second possible advantageous execution example of one performance form considered advantageous of a lamella in accordance with the invention at hand.

Referring to FIG. 4, which represents a lamella in accordance with the invention at hand shaped with an active structure 4 in a form that deadens the lamella's 1 vibration. In this form the border area's 12 border (11) is curved (b), in which case the lamella's length in the lip channel 2 has been increased in the MD-direction and the lamella extends further towards the head box's 3 nozzle part. The lamella's border can extend also through the slice 24 (not illustrated). This way the flow surface that controls the mass flows can be shaped at the same time that it has been possible to move the flow's trailing edge closer to the nozzle part's hole.

Figure 5:
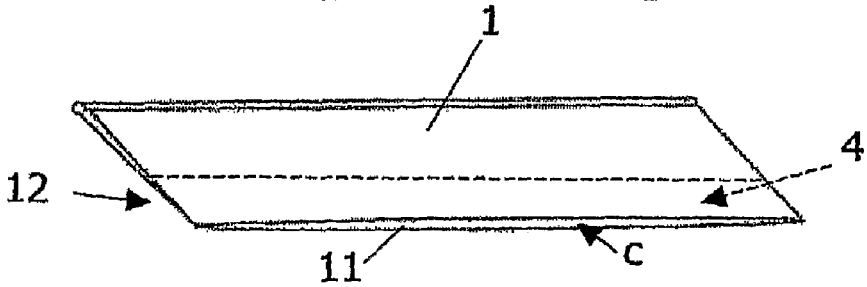
FIG. 5 represents a third possible advantageous execution example of one performance form considered advantageous of a lamella in accordance with the invention at hand.

Referring to FIG. 5, that represents a lamella in accordance with the invention at hand shaped with an active structure 4 in another form, which can deaden the lamella's 1 vibration. In this shape the thickness (c) of the border area's 12 border 11 has been increased, so that the lamella's length in the lip channel can stay substantially unchangeable in the MD-direction at the same time that it is possible to shape the form of the flow's control surface.

When the lamella 1 has been thickened in the Z-direction, also the force needed in bending the lamella is greater. In this way the border area can support without being shaped in the Z-direction greater forces that can be caused for example in the mass flow by a greater viscosity. It is possible to produce mass flow, which flow field and thickness are regular, by this kind of a lamella's shapeable border 12

Referring still generally to FIGS. 3, 4 and 5, the active structure 4 can be integrated in the lamella's 1 border 12, for example by glueing, in this way the active structure can extend in the MD-direction in the whole border area and in the CD-direction to the whole width of the lamella. The active structure can be arranged also to the border area in a way that it is in the border area and ends in the MD-direction from a distance from the lamella's border 11. In the lamella's border area it is also possible to integrate, for example by glueing, a thin coating layer, that can include a layer of hard material like titanium, carbon fiber etc. With the hard coating layer it is possible to reduce generating irregular turbulence in the lamella's trailing edge and the vibration of the lamella's head, in which case in the flow doesn't create irregular impulse and the stagnant wave in the lamella's head can be prevented, and this way also the creating of lamella's natural vibrations can be prevented.

Figure 6:
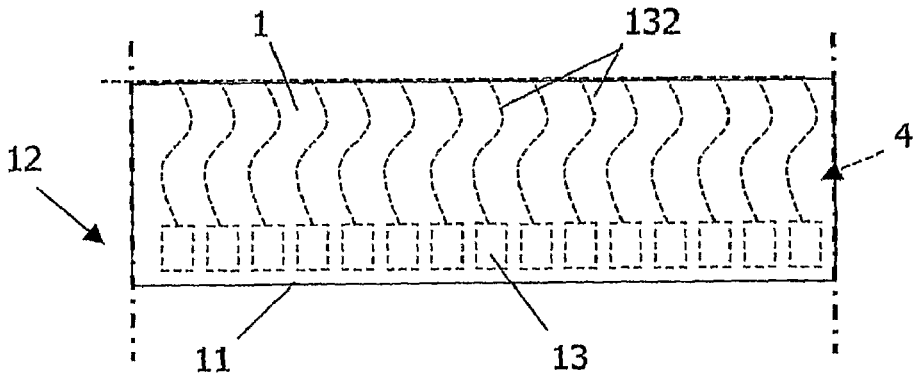
FIG. 6 represents one execution example of how to position the active material/structure inside the lamella.

Reference is made to FIG. 6, which represents a performance example for locating the active material/structure inside the lamella's 1 lamella. In this performance example the lamella's material is carbon fiber and the active material 4 is located in the lamella's border area 12 near the lamella's border 11.

In this performance example the active material consists of several piezo elements which have been located in the lamella's 1 border area 12 side by side in a transversal CD-direction as for the MD-direction. To the piezo elements 13 that form the active material 4 have been connected current conductors 132 for conducting current to the piezo elements. Respectively through the current conductors it is possible to conduct the measurement signal forward.

Figure 7:
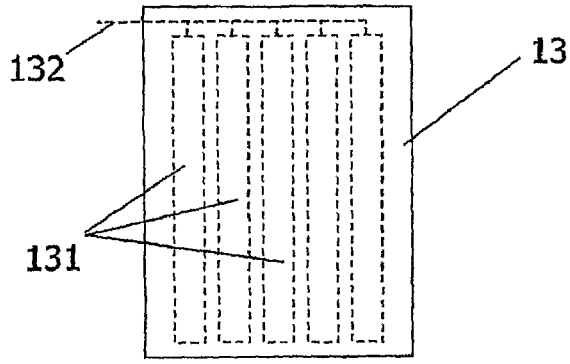
FIG. 7 represents one element of the active material/structure in accordance with FIG. 6, in the lamella.

Reference is made to FIG. 7 that represents a piezo element 13 of the active material 4 or active structure in the lamella 1 in accordance with FIG. 6. As it can be seen from the figure, every piezo element can consist of various adjacent piezo element's lamellas 131, of which in each it is possible to feed the same or more advantageously individual control current. In this case the length of each lamella can be regulated. The width of the lamellas can be chosen and the lamellas can be, if needed, also very thin. An advantageous width of the lamellas is between 0.5-10 mm, in which case also a very precise control range is obtained.

The piezo element 13 can be arranged also in a way that a separate current feeding is not needed. In this case the tension formed with the help of the lamella's 1 vibration in the lamella 131 is conducted in another lamella to regulate the length change or in another lamella's length change.

Figure 8:
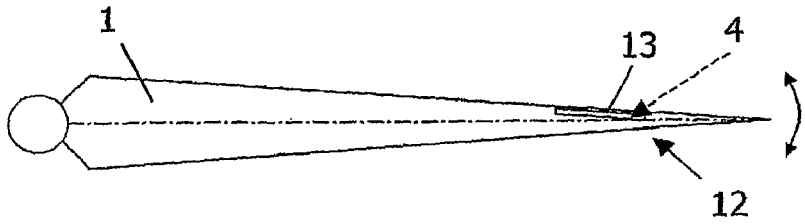
FIG. 8 is a cross-section of the lamella in accordance with the invention, where in the border area there is an active material/structure in accordance with the invention.

Reference is made to FIG. 8 that represents a cross-section of a lamella 1 in accordance with the invention, when in the lamella's border area 12 there is an active material/structure 4 in accordance with the invention. In the figure's performance form the active structure 4 consists of piezo elements 13 that have been located in the lamella's 1 border area inside the lamella. In this case the piezo element doesn't get in touch with the mass suspension. In accordance with the invention the piezo element can be located at any point, but particularly advantageous location of the piezo element is in the lamella's border area near the upper surface or the lower surface and not in the lamella's width's middle axis, which is illustrated in the figure by the dot-and-dash line. In this way the piezo element's length change movement takes place near the lamella's upper surface or lower surface, and because the piezo element is not located in the middle axis, the piezo element's length change causes the passing of the head of the lamella's border area up or down.

The invention at hand has been described here only like an example and with the help of one of its performance forms considered advantageous. As for a craftsman many alternative solutions and variations and other functionally equivalent realizations are clear, so are they possible within the inventive idea defined by the attached requirement configuration.

So it has to be noticed that, because the problem related to the lamellas' vibration is not limited only for single-layer or multi-layer head boxes, the invention at hand gives this way a general solution to the lip channel's turbulences, lamellas' vibration problems, fibrous web line's streak formation problems and other fibrous web line's structure problems, such as level anomalies and blisters.

In one of the example realizations of the invention at hand, the lamella's 1 film base is carbon fiber and the piezo elements that can be very thin, are between 0.5-10 mm. The piezo elements are located in order to get an impact in accordance with the invention in the CD-direction, typically side by side and with a distance from one another inside the lamella material, when it doesn't get in touch with the mass suspension, and near the lamella's 1 border 11. The most advantageous location of the piezo elements is near the lamella's one or both outer surfaces and not in the middle axis of the lamella's width. In this way the piezo element's movement can take place in the direction of its outer surface and not only in the direction of the middle axis' width and for this reason it is possible to create with the piezo element in the head of the lamella a vertical course. In the piezo elements it is possible to include in each an input of current and the piezo elements are arranged most advantageously inside the lamella material and near the head. The piezo elements can be arranged also in a way that there is no need for a separate input of current. In this way it is possible to conduct with the help of the lamella's vibration the lamella's tension in another lamella's length change.

The active structure is located advantageously in the mass' flow direction near the lamella's trailing head or head, most advantageously in the last third of the lamella's machine directional length.

The invention claimed is:

1. A method in a fibrous web machine for actively controlling a lamella in a lip channel of a head box, wherein the lamella has mechanical characteristics, comprising the steps of;

passing a mass flow through the head box and passing the mass flow through the lip channel, so that the mass flow is divided into a plurality of single mass flows which are held separate from each other as the mass flows pass over the lamella;

uniting said plurality of single mass flow after the lamella;

controlling the mechanical characteristics of the lamella by supplying electrical current to a piezo material forming part of the lamella;

wherein the lamella has a portion defining a border area having a stiffness; and wherein the step of controlling the mechanical characteristics of the lamella comprises controlling the stiffness of the border area.

2. The method of claim 1 wherein the lamella has a length in a machine direction and wherein the mechanical characteristics of the lamella which are further controlled is the lamella length in the MD-direction.

3. The method of claim 1 wherein the lamella has a thickness in a Z-direction and wherein the mechanical characteristics of the lamella which are further controlled is the lamella thickness in the Z-direction.

4. The method of claim 1 wherein each mass flow has a mass flow field, and wherein the lamella has a selected shape, and wherein the step of controlling the mechanical characteristics of the lamella comprises controlling the lamella shape so as to keep the mass flow field regular and of a selected thickness.

5. The method of claim 1 further comprising:

forming a paper web;

wherein the lamella has a selected shape and wherein the step of controlling the mechanical characteristics of the lamella comprises controlling the lamella shape to regulate fibre alignment in the paper web.

6. The method of claim 1 further comprising the step of measuring an external parameter in a fibrous web machine and controlling the mechanical characteristics of the lamella based on said external parameter.

7. The method of claim 1 wherein the lamella has a portion defining a border area terminating the lamella in a machine direction at a head, and wherein the step of controlling the mechanical characteristics of the lamella comprises changing the lamella in length in the machine direction so that the piezo material forming part of the lamella causes the head of the border area to bend up or down.

8. The method of claim 1 wherein the piezo material forming part of the lamella is comprised of a plurality of piezo elements and wherein the step of controlling the mechanical characteristics of the lamella by supplying current to said piezo elements comprises supplying current to said piezo elements from a second plurality of piezo elements on a second lamella in the lip channel of the head box.

9. A lamella in a lip channel of a head box, the head box having a slice, the head box located in a fibrous web machine, the lamella comprising:

a lamella body having a cross machine direction width which extends to a width defined by the lip channel, a machine direction length which extends toward or through the slice to a border terminating the lamella body in a machine direction at a head or trailing edge, a Z-direction thickness, and a upper surface and a lower surface and a middle axis therebetween;

wherein the lamella body defines a border area which extends in the cross machine direction the whole width of the lamella body, and the border area further extends in the machine direction over a portion of the length of the lamella body to the border; and a plurality of piezo elements located in the lamella body border area, each piezo element having a current conductor connected thereto.

10. The lamella of claim 9 where each of the piezo elements is a piezo ceramic material.

11. The lamella of claim 10 wherein the lamella body is constructed with carbon fiber and the piezo ceramic material is located in the border area near the border.

12. The lamella of claim 9 wherein the plurality of piezo elements are arranged in the cross machine direction side by side and with a distance from one another inside the lamella body and next to the border.

13. The lamella of claim 9 wherein the plurality of piezo elements is located in the border area not in contact with the upper surface or the lower surface and are spaced from the middle axis.

14. The lamella of claim 9 wherein the plurality of piezo elements are connected in current receiving relation to a second plurality of piezo elements on a second lamella in the lip channel of the head box.

15. The lamella of claim 9 further comprising a regulating unit in measuring data receiving relation to an external source, and in controlling relation to the plurality of piezo elements.

16. The lamella of claim 9 wherein the plurality of piezo elements have a crossmachine direction width of between 0.5-10 mm.

17. A fibrous web machine comprising;

a head box having a lip channel leading to a slice;

at least one lamella in the head box, the lamella having a cross machine direction width which extends to a width defined by the lip channel, a machine direction length which extends toward or through the slice to a border terminating the lamella body in a machine direction at a head or trailing edge, a Z-direction thickness, and an upper surface and a lower surface and a middle axis therebetween;

wherein the lamella body defines a border area which extends in a cross machine direction the whole width of the lamella body, and in the machine direction over a portion of the length of the lamella body to the border;

a plurality of piezo elements located in the lamella, each piezo element having a current conductor connected thereto;

wherein the plurality of piezo elements is located in the lamella body border area.

* * * * *